US005191816A

United States Patent [19]

Burpo

[11] Patent Number: 5,191,816

[45] Date of Patent: Mar. 9, 1993

[54] PARALLEL JAW PLIERS WITH REINFORCED CONSTRUCTION FOR SYMMETRIC FORCE DISTRIBUTION

[76] Inventor: Gary D. Burpo, 2528 Manchester Dr., Springfield, Ill. 62704

[21] Appl. No.: 796,035

[22] Filed: Nov. 20, 1991

[51] Int. Cl.[5] ..... B25B 7/12

[52] U.S. Cl. ..... 81/361; 81/126; 81/362

[58] Field of Search ..... 81/126, 361, 362

[56] References Cited

U.S. PATENT DOCUMENTS 2,399,497 4/1946 Melchers ..... 81/361
2,836,999 6/1958 Ly ..... 81/361

FOREIGN PATENT DOCUMENTS 81261 5/1919 Switzerland ..... 81/362

*Primary Examiner*—James G. Smith
*Attorney, Agent, or Firm*—Rogers, Howell & Haferkamp

[57] ABSTRACT

A parallel jaw pliers apparatus is comprised of a first lever member having a handle at one end and a first jaw surface at its opposite end, a second lever member pivotally connected to the first lever member and having a handle at one end and a pair of arms at its opposite end, and a jaw member mounted to the first lever member for translatory movement relative thereto and mounted to the second lever member for pivoting movement relative thereto. The connections between the first and second lever members and the jaw member provide an unobstructed working area between opposed jaw surfaces of the pliers apparatus. The component parts of the pliers apparatus are constructed to center force distributions through the center of each of the component parts when the pliers are in use. The construction of the component parts is also reinforced to strengthen the connection enabling translatory movement between the jaw member and the first lever member, and to better distribute forces on the jaw member when gripping an object between the opposed jaw surfaces of the pliers apparatus.

14 Claims, 1 Drawing Sheet

PARALLEL JAW PLIERS WITH REINFORCED CONSTRUCTION FOR SYMMETRIC FORCE DISTRIBUTION

BACKGROUND OF THE INVENTION (1) Field of the Invention

The present invention relates to a pair of parallel jaw pliers having a reinforced construction that centers the force distribution in the component parts of the pliers when in use. In particular, the present invention relates to a pair of parallel jaw pliers having a simplified construction with few component parts, where the component parts are constructed with reinforcing elements and are configured to center forces distributed through the component parts during use of the pliers.

(2) Description of the Related Art

Many various types of parallel jaw pliers have been developed in the prior art. The prior art pliers are constructed so that opposed jaw faces or surfaces of the pliers remain substantially parallel to each other as the jaws are closed and opened. To maintain the parallel orientation of the jaw surfaces, prior art parallel jaw pliers are typically constructed of three members. A first member has a handle at one end and a jaw surface at the opposite end. Aa second member has a second jaw surface formed thereon, and is connected with the first member in a manner that enables the second jaw surface to remain substantially parallel to the first jaw surface as the second member is moved toward and away from the first member. A third member has the second handle formed thereon, and is connected with the second member to cause the jaw surface of the second member to move toward and away from the jaw surface of the first member in response to the two handles being moved toward and away from each other, respectively. Examples of these prior art plier structures are disclosed in the U.S. patents of Russell U.S. Pat. No. 82,994; Melchers U.S. Pat. No. 2,399,497; and Ly U.S. Pat. No. 2,836,999.

A disadvantage commonly found in prior art parallel jaw pliers of the type described above is that their construction is not centered in a plane that extends perpendicular through the planes of the opposed jaw surfaces of the pliers. The connections between the opposed jaw members of the prior art pliers are made between opposite sides of the jaw members and are not centered in the jaw members themselves. This construction often produces a lateral force component in the opposed jaw members that tends to separate the jaw members laterally from each other as the gripping force exerted by the jaw members is increased. This lateral force component detracts from the total gripping force that may be exerted on the object gripped between the jaws, and after prolonged use of the pliers could eventually lead to the failure of one or more of the component parts of the pliers.

Prior art parallel jaw pliers have been developed specifically constructed to center the gripping force through the centers of the component parts of the pliers. An example of this type of prior art parallel jaw pliers is disclosed in the U.S. patent of Peck U.S. Pat. No. 1,677,365. These types of prior art pliers also typically employed three members. A first member has a handle at one end and a first jaw surface at its opposite end. A second member has a second jaw surface formed thereon, and is connected in some fashion to the first member to enable the second jaw surface to remain substantially parallel to the first jaw surface as it is moved toward and away from the first jaw surface. A third member has a second handle formed thereon and fork type projections formed at one end that extend around and are connected to opposite sides of the first and second members. This construction of prior art pliers tended to distribute forces exerted on the pliers through the centers of the component parts of the pliers and substantially eliminated the lateral forces exerted on the opposed jaw members of the pliers when in use. However, these types of pliers were often found to be disadvantaged in that their construction required the fork like projections to extend across the working area defined between the opposed jaw surfaces of the pliers. In these types of prior art pliers, the fork like projections often interfered with placement of the pliers over an object to be gripped by the pliers with the object positioned at the extreme rearward area between the opposed jaw surfaces. Positioning an object in this area would often be prevented by engagement of the fork like projections of the pliers against the object, resulting in the fork like projections exerting a gripping force against the object rather than the opposed jaw surfaces of the pliers.

The above types of prior art parallel jaw pliers are also often disadvantaged in that, because the pliers are constructed of several component parts, the dimensions of the parts are reduced so that the pliers can be easily hand held and operated with one hand. Reducing the dimensioning of the component parts of the pliers often resulted in reducing the strength of the connections between the component parts.

What is needed to overcome the disadvantages associated with prior art parallel jaw pliers is a pair of parallel jaw pliers that is constructed in such a way that the component parts of the pliers are kept to a minimum, that the working area defined between the opposed jaw surfaces of the pliers is not obstructed by any of the component parts of the pliers for all adjusted positions of the jaw surfaces relative to each other, and where the component parts of the pliers are constructed in such a way that the connections between component parts enable the parts to move in both pivoting and translatory movements relative to each other and are reinforced without appreciably increasing the size of the component parts of the pliers.

SUMMARY OF THE INVENTION

The parallel jaw pliers apparatus of the present invention overcomes disadvantages commonly associated with prior art parallel jaw pliers by providing a parallel jaw pliers apparatus constructed of component parts interconnected to permit relative pivoting and translatory movement between component parts, wherein the interconnections are reinforced enabling the pliers apparatus to exert a substantial gripping force on an object. Furthermore, the component parts of the apparatus of the invention are constructed in a manner that centers the distribution of forces in the component parts when the apparatus is in use. The apparatus of the invention is also constructed to provide an unobstructed working area between opposed jaw surfaces of the pliers where no component parts of the pliers extend into, overlap, or obstruct the working area between the opposed jaw surfaces in any of the adjustable positions of the jaw surfaces relative to each other.

The parallel jaw pliers apparatus of the present invention is generally comprised of first and second lever members and a jaw member that are interconnected to each other for relative translatory and pivoting movement. Each of the component parts of the invention are preferably cast from metal and then machined to their specific configurations. However, the apparatus of the invention may be constructed according to a variety of methods and the scope of the invention is not intended to be limited by any particular method of constructing the apparatus.

The first lever member of the apparatus is configured having a handle at one end and a jaw member at its opposite end. The jaw member has a jaw surface formed thereon, and a groove is formed extending into the jaw member and along a side of the jaw member substantially perpendicular to the first jaw surface. A hole is also formed extending through the first jaw member. The hole has substantially the same configuration as the groove and is continuous with the groove.

The second lever member is configured with a second handle at one end and a pair of spaced arms at its opposite end. The first lever member is received between the spaced arms of the second lever member. Coaxial holes are formed through the pair of arms and through the first lever member received between the pair of arms. A pivot pin is secured extending through the coaxial holes, thereby pivotally connecting the first and second lever members. Oblong slots extend through the distal ends of the pair of arms and a back brace extends across the spacing between the arms and connects the distal ends of the arms.

The jaw member is configured with a second jaw engaging surface thereon. A tongue projects from one side of the jaw member and extends along the side of the jaw member substantially perpendicular to the second jaw surface of the member. The tongue has a configuration complementary to the configuration of the groove formed in the first jaw member, and a section of the tongue extends a short distance beyond the plane of the second jaw surface of the jaw member. The jaw member is received in the spacing between the pair of arms of the second lever member, and the tongue of the jaw member is received for sliding movement in the groove formed in the first lever member. A hole through the jaw member registers with the pair of oblong slots formed in the distal ends of the pair of arms. A second pivot pin is secured in the jaw member hole and opposite ends of the pin engage in the oblong slots of the arms. A cam surface is formed on one side of the jaw member. The cam surface engages in sliding engagement with the back brace connecting the arms of the second lever member.

In operation of the parallel jaw pliers apparatus, pivoting the first and second handles toward each other causes the first and second lever members to pivot about the first pivot pin and the distal ends of the pair of arms to move toward the first jaw surface of the first lever member. The movement of the pair of arms pushes the jaw member and the second jaw surface toward the first jaw surface and causes the tongue of the second jaw member to slide through the groove of the first lever.

Moving the first and second handles away from each other pivots the first and second lever members relative to each other about the first pivot pin and causes the distal ends of the pair of arms to move away from the first jaw surface of the first lever member. The movement of the distal ends of the pair of arms away from the first jaw surface forces the tongue of the second jaw member to slide through the groove away from the first jaw surface and moves the second jaw surface away from the first jaw surface.

In the total range of movement of the second jaw surface relative to the first jaw surface, from the first and second jaw surfaces contacting to the first and second jaw surfaces being spaced their maximum spacing apart from each other, the area between the mutually opposed, parallel jaw surfaces remains unobstructed by the pair of arms of the second lever member. Throughout the entire range of movement of the second jaw member relative to the first jaw member, the pair of arms are positioned on opposite sides of the second jaw member and do not extend beyond the second jaw surface. By configuring the pair of arms of the second lever member in this manner, they are prevented from entering the working area defined between the opposed jaw surfaces and do not obstruct access into the working area between the jaw surfaces from opposite sides of the pliers apparatus for all adjusted positions of the second jaw relative to the first jaw.

By constructing the pair of arms of the second lever member with the back brace extending across the pair of arms and engaging in sliding contact with the cam surface of the second jaw member, the pair of arms are strengthened against forces that would tend to separate the arms and the forces exerted by the second lever to cause the second jaw member to move toward the first jaw member are exerted against both the second pivot pin secured in the second jaw member and the cam surface engaged by the back brace. By constructing the second jaw member with the tongue extension that projects beyond the plane of the second jaw surface, an increased surface area of engagement is provided between the first and second jaw members that resist separation of the second jaw member from the first jaw member.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

Figure 1:
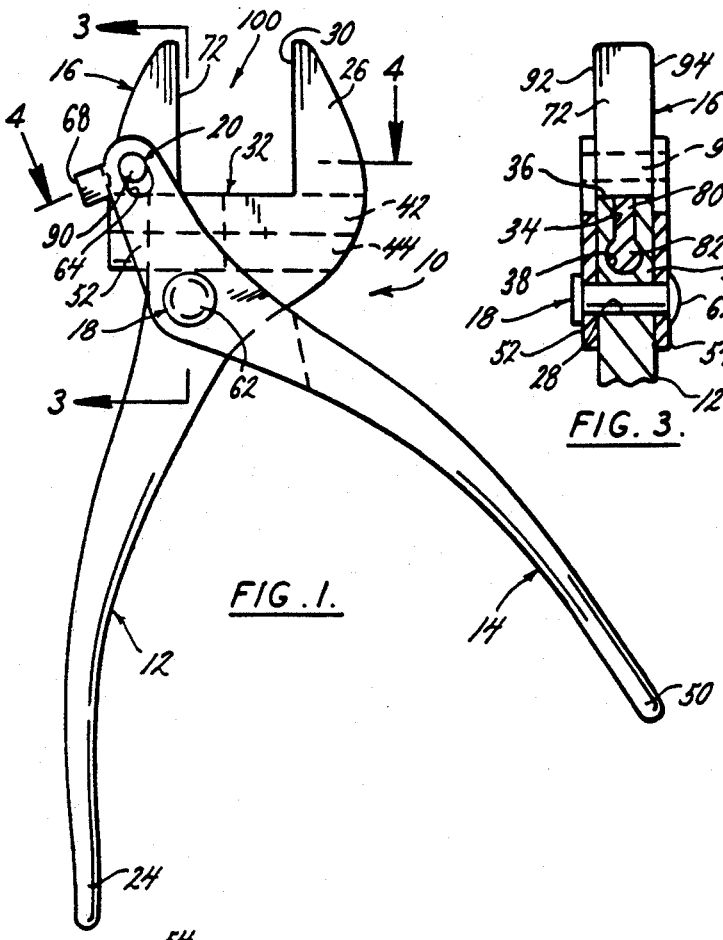
FIG. 1 is a side elevation view of the parallel jaw pliers apparatus of the present invention.

FIG. 1 shows the parallel jaw pliers apparatus 10 of the present invention. The apparatus is generally comprised of a first lever member 12, a second lever member 14, a jaw member 16, and first and second pivot pins 18, 20 interconnecting the component parts of the apparatus.

Figure 3:
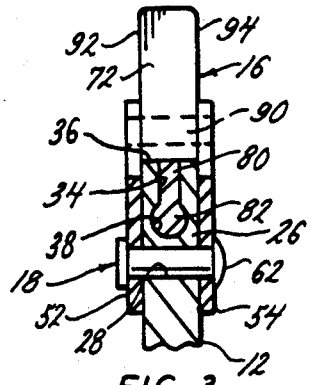
FIG. 3 is a partial and elevation view, in section of the apparatus taken along the line 3—3 of FIG. 1.
Figure 2:
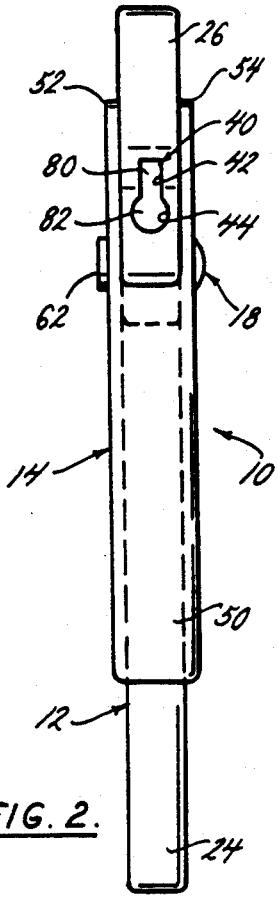
FIG. 2 is an end elevation view of the pliers apparatus of the present invention viewed from the right side of FIG. 1.
Figure 4:
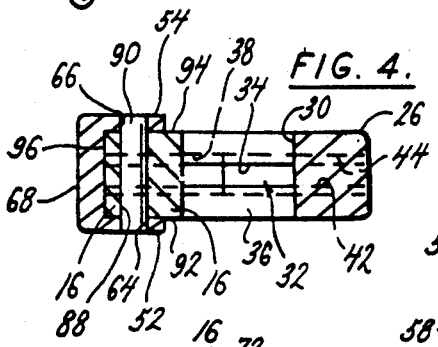
FIG. 4 is a plan view, in section, of the apparatus taken along the line 4—4 of FIG. 1.

The first lever member is configured with a first manual handle 24 at one end and a first jaw 26 at its opposite end. A pivot hole 28 is formed through the first lever member 12 between its first and second ends. A substantially planar first jaw surface or face 30 is formed on the first jaw 26 of the lever member. A groove 32 is formed projecting into the center of the first lever member 12. As is best seen in FIG. 3, the groove 32 is comprised of two distinct sections. A first substantially rectangular section 34 of the groove projects from a side 36 of the first lever member into the lever member in a direction substantially parallel with the planar surface of the first jaw surface 30. The groove extends along the side 36 of the lever member 12 in a direction substantially perpendicular to the planar surface of the first jaw surface 30. A second section 38 at the bottom of the groove 34 has a general cylindrical configuration. The second groove section 38 extends substantially parallel to the side 36 of the lever member and perpendicular to the planar surface of the first jaw surface 30.

A guide hole 40 also extends through the center of the first lever member 12. The guide hole 40 is continuous with the groove 32 and is also provided with a substantially rectangular section 42 and a cylindrical section 44.

The second lever member 14 is formed with a second manual handle 50 at one end and a pair of spaced arms 52, 54 at its opposite end. A spacing 56 is provided between the pair of arms 52, 54 and the first lever member 12 is received in the spacing. Coaxial holes 58, 60 extend through the pair of arms 52, 54 and register with the pivot hole 28 in the first lever member 12. A first pivot pin 62 is inserted through the pair of coaxial holes 58, 60 and the pivot hole 28 and is secured therein, pivotally connecting the second lever member 14 to the first lever member 12 with the pair of arms 52, 54 extending over opposite sides of the first lever member 12. A pair of oblong slots 64, 66 are provided through the distal ends of the pair of arms 52, 54. The pair of slots 64, 66 are positioned in register with each other. A back brace 68 is secured to the distal ends of the pair of arms 52, 54 extending across the spacing 56 between the arms and connecting the distal ends of the arms to each other.

Figure 6:
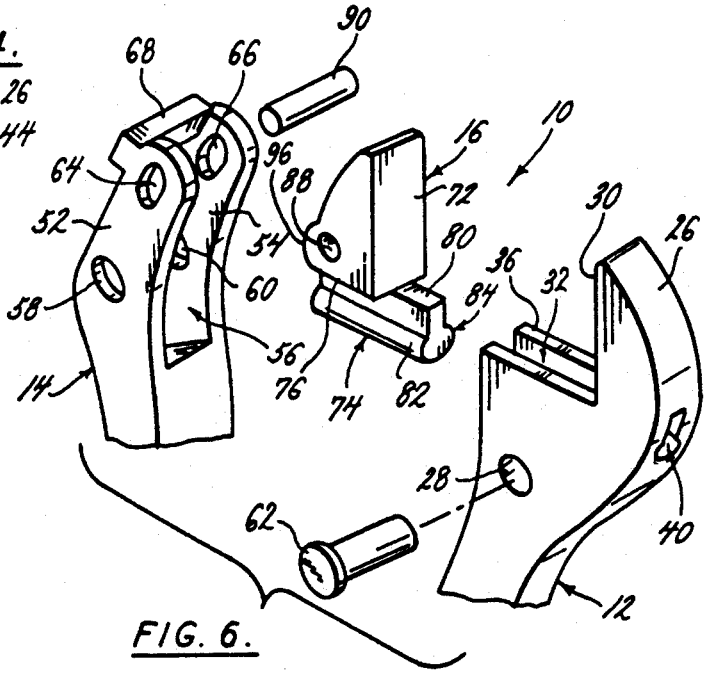
FIG. 6 is a partial exploded view showing the detail of the separate component parts of the apparatus of the invention.

The jaw member 16 is formed with a substantially planar second jaw surface or face 72 thereon and a tongue 74 projecting therefrom. The tongue 74 projects from one side 76 of the jaw member in a direction substantially parallel to the plane of the second jaw surface 72. The tongue 74 extends along the jaw member side 76 in a direction substantially perpendicular to the plane of the second jaw surface 72. The tongue 74 has a configuration complementary to the configuration of the groove 32 and the guide hole 40 and comprises a first substantially rectangular section 80 projecting from the jaw member side 76 and a second substantially cylindrical section 82 along the distal end of the rectangular section. A section of the tongue 84 projects a slight distance beyond the plane of the second jaw surface 72 as is best seen in FIG. 6. The tongue 74 is received in sliding engagement in the groove 32, thereby mounting the jaw member 16 to the jaw 26 of the first lever member 12 for translatory movement relative thereto.

A second pivot hole 88 extends through the jaw member 16 and a second pivot pin 90 is secured in the hole. Opposite ends of the second pivot pin 90 project beyond opposite sides 92, 94 of the jaw member 16 and engage in the oblong slots 64, 66 at the distal ends of the first lever member pair of arms 52, 54. The opposite ends of the pin 90 provide a lost motion and pivoting connection between the jaw member 16 and the distal ends of the first lever member pair of arms 52, 54.

A cam surface 96 is formed on a side of the jaw member 16 opposite the second jaw surface 72 of the member. The cam surface 96 engages in contact with the first lever member back brace 68.

Figure 5:
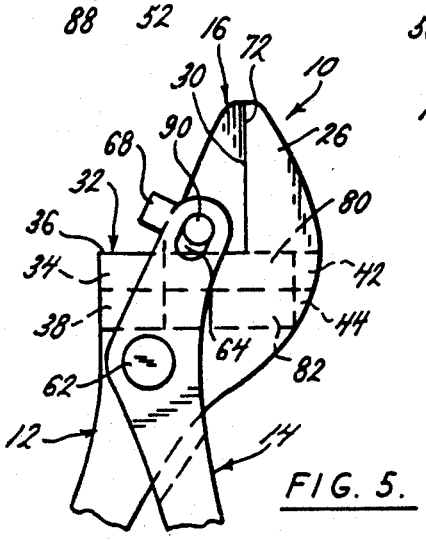
FIG. 5 is a partial side elevation view of the apparatus of the invention showing the jaw in their closed positions.

In operation of the parallel jaw pliers apparatus 10, by moving the first and second manual handles 24, 50 toward each other, the second jaw surface 72 is moved toward the first jaw surface 30 as the tongue 74 slides through the groove 32. As the second jaw surface 72 approaches and contacts the first jaw surface 30 as shown in FIG. 5, the projecting section of the tongue 84 is inserted into the guide hole 40 extending through the first jaw 26. Simultaneously with the movement of the second jaw surface 72 toward the first jaw surface 30, the back brace 68 slides over the cam surface 96 of the jaw member 16 from a lower edge of the surface as seen in FIG. 1, to an upper edge of the surface as seen in FIG. 5. It can be seen that the engagement of the back brace 68 with the cam surface 96 assists in pushing the jaw member 16 toward the first jaw surface 30. In this manner, the forces exerted on the jaw member 16 that move the jaw member toward the first jaw 26 and exert a gripping force on an object inserted in the working area between the first and second jaw surfaces 30, 72 is distributed between the engagement of the first lever member slots 64, 66 with the second pivot pin 20 and the engagement of the back brace 66 on the cam surface 96. In addition, the back brace 68 extending across the pivot arms 52, 54 of the first lever member resists lateral forces that would tend to separate the lever arms as an object is gripped between the first and second jaw surfaces 30, 72.

As an object is gripped between the first and second jaw surfaces 30, 72, the forces exerted on the jaw surfaces tend to rotate the jaw member 16 in a counterclockwise direction as viewed in FIG. 1. The engagement of the tongue 74 in the groove 32 resists these forces. In particular, the engagement of the projecting section of the tongue 84 in the groove 32 and the guide hole 40 provides added strength to the connection between the jaw member 16 and the first jaw 26 to resist the forces exerted against the jaw member. It should be apparent that the addition of the projecting section of the tongue 84 to the jaw member tongue 74 increases the ability of the tongue 74 to resist forces that would tend to rotate the jaw member 16 counterclockwise and separate the jaw member from the first jaw 26 over tongue and groove sliding connections of the prior art that do not employ the projecting tongue section of the present invention.

FIG. 1 shows the pliers apparatus of the invention with the jaw surfaces 30, 72 spread apart to their furthest extent and defining the largest working area 100 between the jaw surfaces. In this relative position of the jaw surfaces, the pair of arms 52, 54 of the second lever member 14 are still positioned on opposite sides 92, 94 of the jaw member 16 and do not project or extend out over any portion of the second jaw surface 72. This particular configuration of the pair of arms 52, 54 prevents the arms from obstructing access to the working area 100 between the jaw surfaces 30, 32 from opposite sides of the pliers. When the jaw surfaces 30, 72 are completely closed and contact each other as shown in FIG. 5, the pair of arms 52, 54 are still positioned on the opposite sides 92, 94 of the jaw member 16 and do not project over the second jaw surface 72 of the jaw member. In all adjusted positions of the second jaw surface 72 relative to the first jaw surface 30, the pair of arms 52, 54 are so configured that they will not project or extend over the second jaw surface 72 and interfere with or obstruct any object being inserted into the working area 100 between the first and second jaw surfaces 30, 72 from opposite sides of the pliers.

It is also pointed out that as the first and second manual handles 24, 50 are moved toward each other and the second jaw surface 72 is moved toward the first jaw surface 30 to grip an object therebetween, the second pivot pin 20 will tend to slide downward through the oblong slots 64, 66 as viewed in FIG. 1. The second pivot pin 20 will continue to move downward through the oblong slots 64, 66 and will reach the bottom of the slot when the second jaw surface 72 is at its midpoint of travel toward the first jaw surface 30. At this position of the second jaw surface 72 relative to the first jaw surface 30, the lever arm between the second pivot pin 20 and the first pivot pin 18 is its shortest and the pliers jaw surfaces 30, 72 are able to exert their greatest gripping force on an object gripped between the jaw surfaces. This particular configuration of the pliers apparatus of the invention enables the apparatus to exert an increasing gripping force on an object gripped between the first and second jaw surfaces 30, 72 to the maximum gripping force achievable by the pliers apparatus when the second jaw surface 72 has traveled to the midpoint of its maximum spacing from the first jaw surface 30.

While the present invention has been described by reference to a specific embodiment, it should be understood that modifications and variations of the invention may be constructed without departing from the scope of the invention defined in the following claims.

What is claimed is:

1. A pliers apparatus comprising:

a first lever having a first jaw surface and a first handle formed thereon;

a jaw member connected to the first lever for translatory movement relative thereto, the jaw member having a second jaw surface formed thereon, the second jaw surface being parallel to and mutually opposed by the first jaw surface as the jaw member is moved relative to the first lever, the first and second jaw surfaces defining a working area therebetween for receiving objects to be engaged between the first and second jaw surfaces;

a second lever having a pair of spaced arms and a second handle formed thereon, the first lever and the jaw member begin received in a space between the pair of arms and the pair of arms being connected to both the first lever and the jaw member for pivoting movement relative thereto, the pair of arms having a configuration that positions the pair of arms outside the working area defined between the first and second jaw surfaces and prevents the pair of arms from extending over the working area from opposite sides of the jaw member for all adjusted relative positions of the first and second jaw surfaces as the second jaw is moved relative to the first jaw;

a cam surface is formed on a side of the jaw member; and a back brace is formed on the pair of arms extending across the space between the pair of arms and connecting the pair of arms, the back brace engages in sliding contact with the cam surface of the jaw member as the second jaw surface is moved toward and away form the first jaw surface.

2. The apparatus of claim 1, wherein:

the pair of arms extend over opposite sides of the jaw member and do not extend beyond the second jaw surface from the opposite sides of the jaw member as the jaw member is moved relative to the first lever.

3. The apparatus of claim 1, wherein:

a groove is formed in a side of the first lever adjacent the first jaw surface and a guide hole is formed through the first lever and is continuous with the groove, a tongue is formed along a side of the jaw member and a section of the tongue projects from the jaw member beyond the second jaw surface, the tongue is received in sliding engagement in the groove thereby connecting the jaw member to the first lever for translatory movement relative thereto, and the tongue section is inserted into the guide hole and is withdrawn from the guide hole as the second jaw surface is moved toward and away from the first jaw surface, respectively.

4. The apparatus of claim 1, wherein:

a pair of slots are formed through the pair of arms and a pivot pin projects from opposite sides of the jaw member into each of the slots thereby connecting the pair of arms to the jaw member for pivoting movement relative thereto.

5. The apparatus of claim 4, wherein:

a pair of coaxial holes are formed through the pair of arms and a pivot hole is formed through the first lever in register with the pair of holes, a second pivot pin is secured in the pivot hole and opposite ends of the second pivot pin extend into the pair of holes thereby connecting the pair of arms to the first lever for pivoting movement relative thereto.

6. The apparatus of claim 5, wherein:

each of the first lever, the jaw member, the second lever, and the first and second pivot pins are formed as unitary elements.

7. A pliers apparatus comprising:

a first lever having opposite first and second ends, the first end being formed as a first handle and the second end being formed as a first jaw, the first jaw having a first jaw surface formed thereon;

a second lever having opposite first and second ends, the first end of the second lever begin formed as a second handle and the second end of the second lever being formed as a pair of arms with a space provided between the arms, the first lever being received in the space and the pair of arms extending over opposite sides of the first lever;

means for connecting the first lever to the second lever for pivoting movement of the first lever relative to the second lever in response to movement of the first handle relative to the second handle;

a second jaw having a second jaw surface formed thereon, the second jaw being received in the space between the pair of arms and the pair of arms extending over opposite side so the second jaw;

means for connecting the second jaw to the first jaw for relative movement therebetween with the second jaw surface being parallel to and mutually opposed by the first jaw surface as the second jaw is moved relative to the first jaw, the first jaw surface and the second jaw surface defining a working area therebetween for receiving object to be engaged between the first and second jaw surfaces;

means for connecting the pair of arms to the second jaw for pivoting movement of the pair of arms relative to the second jaw and for causing movement of the second jaw relative to the first jaw in response to movement of the first handle relative to the second handle, the pair of arms being configured to remain outside the working area between the first and second jaw surfaces and not project into or extend move the working area between the first and second jaw surface as the second jaw is moved relative to the first jaw;

a cam surface is formed on a side of the second jaw opposite the second jaw surface; and, a back brace is formed extending across the space provided between the arms and connecting the pair of arms, the back brace engages the cam surface and slides over the ca surface as the second jaw is moved relative to the first jaw.

8. The apparatus of claim 7, wherein:

the second jaw is movable relative to the first jaw between a first position of the second jaw relative to the first jaw where the second jaw surface contacts the first jaw surface, and a second position of the second jaw relative to the first jaw where the second jaw surface is spaced at a maximum spacing from the first jaw surface; and, the pair of arms do not extend beyond the second jaw surface of the second jaw from the opposite sides of the second jaw as the second jaw is moved relative to the first jaw between the first and second positions of the second jaw relative to the first jaw.

9. The apparatus of claim 7, wherein:

the means for connecting the second jaw to the first jaw includes a groove formed in a side of the first jaw adjacent the first jaw surface and a guide hole formed through the first jaw continuous with the groove, and a tongue formed along a side of the second jaw adjacent the second jaw surface, a section of the tongue projecting from the second jaw beyond the second jaw surface, the tongue being received in sliding engagement in the groove thereby connecting the second jaw to the first jaw for relative movement therebetween, and the tongue section being inserted into the guide hole and being withdrawn from the guide hole as the second jaw is moved relative to the first jaw.

10. A pliers apparatus comprising:

a first lever having opposite first and second ends, the first ned of ht lever being formed as a first handle and the second end of the lever being formed as a first jaw, the first jaw having a first jaw face formed thereon and having a groove formed therein, the groove extending along a side of the lever in a direction substantially perpendicular to the first jaw face and the groove projecting into the side of the lever in a direction substantially parallel to the first jaw face;

a second lever having opposite first and second ends, the first ned of the second lever being formed as a second handle and the second end of the second lever being formed as a pair of arms with a space provided between the arms, the first lever being received in the space and the pair of arms extending over opposite sides of the first lever and being connected to the first lever for pivoting movement relative thereto;

a second jaw having a second jaw face and a tongue formed thereon, the tongue extending along a side of the second jaw in a direction substantially perpendicular to the second jaw face and the tongue projecting for the side of the second jaw in a direction substantially parallel to the second jaw face, the tongue being received in sliding engagement in the groove of the first jaw thereby mounting the second jaw to the first jaw for selective relative movement of the second jaw face toward and away form the first jaw face with the first and second jaw faces being substantially parallel, the second jaw begin pivotally connected to the pair of arms of the first lever thereby causing the second jaw face to move selectively toward and away from the first jaw face in response to the first and second handles of the first and second levers being pivoted toward and away form each other, respectively;

the second jaw has a cam surface formed on a side of the second jaw; and the second lever has a back brace formed thereon connecting ht pair of arms and extending across the space between the pair of arms, the back brace engaging in sliding engagement with the cam surface of the second jaw as the first and second handles of the first and second levers are pivoted toward and away form each other.

11. The apparatus of claim 10, wherein:

the first jaw is formed with a hole extending therethorugh, the hole being continuous with the groove;

the tongue of the second jaw is formed with a section extending from the second jaw in said direction perpendicular to the second jaw face, the tongue section being moved into the hole through the first jaw in response to the first and second handles being pivoted toward each other, and the tongue section being withdrawn from the hole through the first jaw in response to the first and second handles being pivoted away form each other.

12. The apparatus of claim 10, wherein:

a pair of oblong slots are formed through the pair of arms of the second lever and a hole is formed through the second jaw, the pair of slots register with the hole in the second jaw, and a pivot pin is secured in the hole in the second jaw, the pivot pin extends from opposite sides of the second jaw into the pair of oblong slots thereby forming the pivot connection between the second jaw and the pair of arms.

13. The apparatus of claim 10, wherein:

a pair of coaxial holes are formed through the pair of arms of the second lever and a pivot hole is formed through the first lever in register with the pair of holes, a pivot pin is secured in the pivot hole and opposite ends of the pin extend into the pair of holes thereby forming a pivot connection between the first lever and the pair of arms.

14. The apparatus of claim 10, wherein:

the second jaw is movable relative to the first jaw between a first position of the second jaw relative to the first jaw where the second jaw face contacts the first jaw face, and a second position of the second jaw relative to the first jaw where the second jaw face is spaced at a maximum spacing from the first jaw face; and, the pair of arms being connected to opposite sides of the second jaw and being configured so that they do not extend past the second jaw face from the opposite sides of the second jaw as the second jaw is moved relative to the first jaw between the first and second positions of the second jaw relative to the first jaw.

* * * * *